United States Patent [19]

Alexander

[11] Patent Number: 4,605,181

[45] Date of Patent: Aug. 12, 1986

[54] STRAND TENSION CONTROLLING APPARATUS

[75] Inventor: James L. Alexander, Charlotte, N.C.

[73] Assignee: McCoy-Ellison, Inc., Monroe, N.C.

[21] Appl. No.: 714,724

[22] Filed: Mar. 22, 1985

[51] Int. Cl.[4] ..... B65H 59/24

[52] U.S. Cl. ..... 242/149; 242/129.8; 242/154

[58] Field of Search ..... 226/195; 242/149, 150 R, 242/150 M, 147 R, 147 M, 153, 154, 129.8, 131, 131.1, 75.2

[56] References Cited

U.S. PATENT DOCUMENTS 2,912,185 11/1959 Vossen ..... 242/150 R

*Primary Examiner*—Stanley N. Gilreath

*Attorney, Agent, or Firm*—Shefte, Pinckney & Sawyer

[57] ABSTRACT

A mechanical device for controlling the tension in a traveling textile yarn includes a base, a flutter member pivotably mounted on the base and a cylindrical post eccentrically mounted rotatably on the base adjacent the post, the flutter member and post being independently biased toward one another and yieldably movable independently away from and toward one another. A yarn monitoring arm is integral with the post and extends outwardly therefrom for engagement with a traveling yarn passing between the post and the flutter member. Tension increases and decreases in the yarn act on the monitoring arm to effect movement of the post in its rotational directions away from and toward the flutter member to increase and decrease the frictional drag and thereby offset the tension change. The flutter member yields to yarn thickness fluctuations and is adapted for flutter-like pivotal movement in response to yarn ballooning and untwisting actions to dampen same while maintaining the frictional drag on the yarn. The device is effective for maintaining a very low amount of tension in a traveling yarn while still providing an effective stop motion.

21 Claims, 7 Drawing Figures

STRAND TENSION CONTROLLING APPARATUS

BACKGROUND OF THE INVENTION

The present invention relates to apparatus for controlling the tension in a traveling textile yarn or like advancing strand material. As used herein, the terms "yarn," "strand" and "strand material" are to be interpreted in their broadest sense to generically encompass these and all other similar continuous length materials, including, but not limited to, thread, string, filament, fiber, cord, rope, wire, tape, ribbon, sliver, or other yarn-like or strand-like material.

In virtually all systems involving the handling of strand materials, it is a characteristic requirement that the tension conditions in the material be controlled in order to best insure high quality results. This is particularly true in the handling of traveling yarns in typical textile manufacturing systems. Conventionally, the control of strand tension in such operations has been commercially achieved by imposing an essentially fixed restraint, drag or load on the advancing strand. Various mechanical devices are well known for exerting a frictional drag on an advancing strand to perform this manner of tension control, including, for example, opposed disc pairs biased toward one another between which the strand passes, and interdigitating fingers or successively arranged pulleys or rollers for causing an advancing strand to travel in a sinuous path. In recent years, in order to avoid the perceived disadvantages of frictionally contacting a traveling strand, various alternative devices have been proposed wherein strand material is trained about a wheel or capstan to which a controlled braking force is applied magnetically, electromagnetically or by similar means to tension the strand material.

While these various devices differ significantly in their structures and manners of operation, virtually all operate on the basic principal of controlling strand tension by the imposition of an essentially fixed restraining force on the strand material and therein all such devices suffer the common fundamental inability to accommodate and offset fluctuations in the tension conditions in the strand material which naturally occur. For instance, in textile yarn handling systems, it is widely known to be a natural characteristic of yarn wound in packages to vary greatly in winding tension over the entire length of the yarn and that varying other forces may be imposed on the yarn during handling, which in combination create widely and sometimes radically fluctuating tension conditions in the yarn. Given these varying yarn tension conditions, tension controlling devices such as those described above provide only moderate effectiveness in maintaining yarn tension within a desirable range and are essentially effective primarily in merely maintaining a minimum tension in the yarn. Specifically, the restraint imposed by these devices on the traveling yarn is effective to compensate for downward tension fluctuations by maintaining a minimum restraint against yarn travel. However, such devices effectively magnify upward tension fluctuations in the yarn, rather than compensating for and offsetting such fluctuations, sometimes resulting in yarn breakage. Furthermore, while in many operations, it would be optimally preferred that as little tension as possible be maintained in a traveling yarn or other strand material, these devices typically impose a relatively significant tension in the stand material.

The magnetically and electromagnetically operated devices are reputed to be capable of more accurate setting to desired tension levels than mechanical tension devices so that the restraint imposed by these devices theoretically can be better regulated to minimize the deleterious effects of imposing a fixed restraint on a traveling strand. One such device disclosed in White U.S. Pat. No. 3,797,775, issued Mar. 19, 1974, entitled "Strand Tension Control," proposes an embodiment thereof in a closed loop control arrangement wherein the electromagnetically imposed restraint is continuously modified in response to tension variations detected by an electrically-operated strand sensing device to increase or decrease the restraint imposed to attain a desired constant tension condition. However, in actual practice, this device has not proved to be reliably operable in a commercial setting. Furthermore, such devices are significantly more complex and expensive than mechanical tension control devices and are not widely considered to perform any more satisfactorily in actual commercial use than mechanical devices. Accordingly, mechanical devices such as those described above, being simpler and less costly, are most widely used in industry despite their inability to compensate for and offset fluctuations in strand tension.

Accordingly, it is an object of the present invention to provide a strand tension control device of simple and inexpensive construction which is mechanically operable to monitor tension fluctuations in a traveling strand and to impose a varying frictional tension drag thereon in direct relation and response to tension fluctuations.

SUMMARY OF THE INVENTION

Briefly described, the present strand tension controlling apparatus includes a base and a strand tensioning arrangement movably mounted on the base for variable engagement with an advancing strand for applying a variable frictional drag on the strand. The tensioning arrangement includes a movable control member arranged for engagement with the strand for movement in response to tension fluctuations therein for decreasing and increasing the frictional drag applied thereto in relation to increases and decreases in the amount of tension in the strand to compensate for and offset tension fluctuations from a desired constant tension value. A guide arrangement is provided for directing the strand to advance in a path of travel in engagement with the strand tensioning arrangement and in tensioned engagement with the control member. In this manner, fluctuations in the tension in the strand are controlled and the strand tension is maintained within a substantially uniform range about the desired constant tension value.

The apparatus is preferably embodied for controlling the tension in a traveling textile yarn or like strand. In such embodiment, the strand tensioning arrangement includes two yarn engaging members adjacently mounted on the base for independent movement toward and away from surface engagement with one another. Preferably, the yarn engaging members include a flutter member pivotably mounted on the base and a post rotatably mounted on the base adjacent and parallel to the flutter member and eccentrically about an axis substantially parallel to the pivot axis of the flutter member for rotational movement toward and away from the plate. A biasing arrangement is provided for independently urging the flutter member and the post toward surface contact with one another and for yieldably permitting independent pivotal movement of the flutter member and rotational movement of the post away from and toward one another. The flutter member and the biasing arrangement are cooperatively adapted to urge the flutter member into following relation with the post with a decreasing biasing force during an initial range of rotational movement of the post in the direction away from the flutter member. In this manner, the frictional drag on the yarn is increased and decreased in direct relation to rotational movement of the post in its rotational directions toward and away from the flutter member. The flutter member and the biasing arrangement are further cooperatively arranged to yield to variations in strand thickness and for flutter-like pivotal movement toward and away from the post in response to ballooning and untwisting actions of the yarn for dampening such yarn actions while maintaining the frictional drag on the yarn. The control member preferably includes a yarn monitoring arm affixed integrally with the post for unitary movement therewith and extending outwardly therefrom for engagement with the yarn at a downline spacing from the post and the flutter member for unitary movement of the arm and the post in response to tension fluctuations in the yarn. The yarn monitoring arm thusly controls rotational movement of the post in the directions toward and away from the flutter member in direct relation to decreases and increases in the amount of tension in the yarn for correspondingly increasing and decreasing the frictional drag applied to the yarn to compensate for and offset variations in yarn tension from the desired constant tension value.

According to a feature of the present invention, the biasing arrangement is adapted for applying a biasing force to the post at a predetermined rate of change during movement thereof and in direct relation to the degree of movement of the post in its rotational direction away from the flutter member. Preferably, the biasing arrangement includes a cam arrangement for causing the biasing arrangement to apply the biasing force at a decreasing rate of change during rotational movement of the post in another initial range of movement thereof in its rotational direction away from the flutter member and at least at a generally constant rate of change during movement of the post in a further range of rotational movement thereof beyond such initial range of movement. The cam arrangement is affixed to the post for integral movement therewith about its rotational axis. A biasing element is affixed to the post eccentrically from the rotational axis for biasing movement upon movement of the post, the biasing element being arranged for biasing movement out of engagement with the cam arrangement during movement of the post in its another initial range of movement and for biasing movement in engagement with the cam arrangement during movement of the post in its further range of movement. The biasing arrangement further preferably includes an arrangement for selectively fine adjusting the biasing force and disposition of the biasing arrangement.

DESCRIPTION OF THE PREFERRED EMBODIMENT

Figure 1:
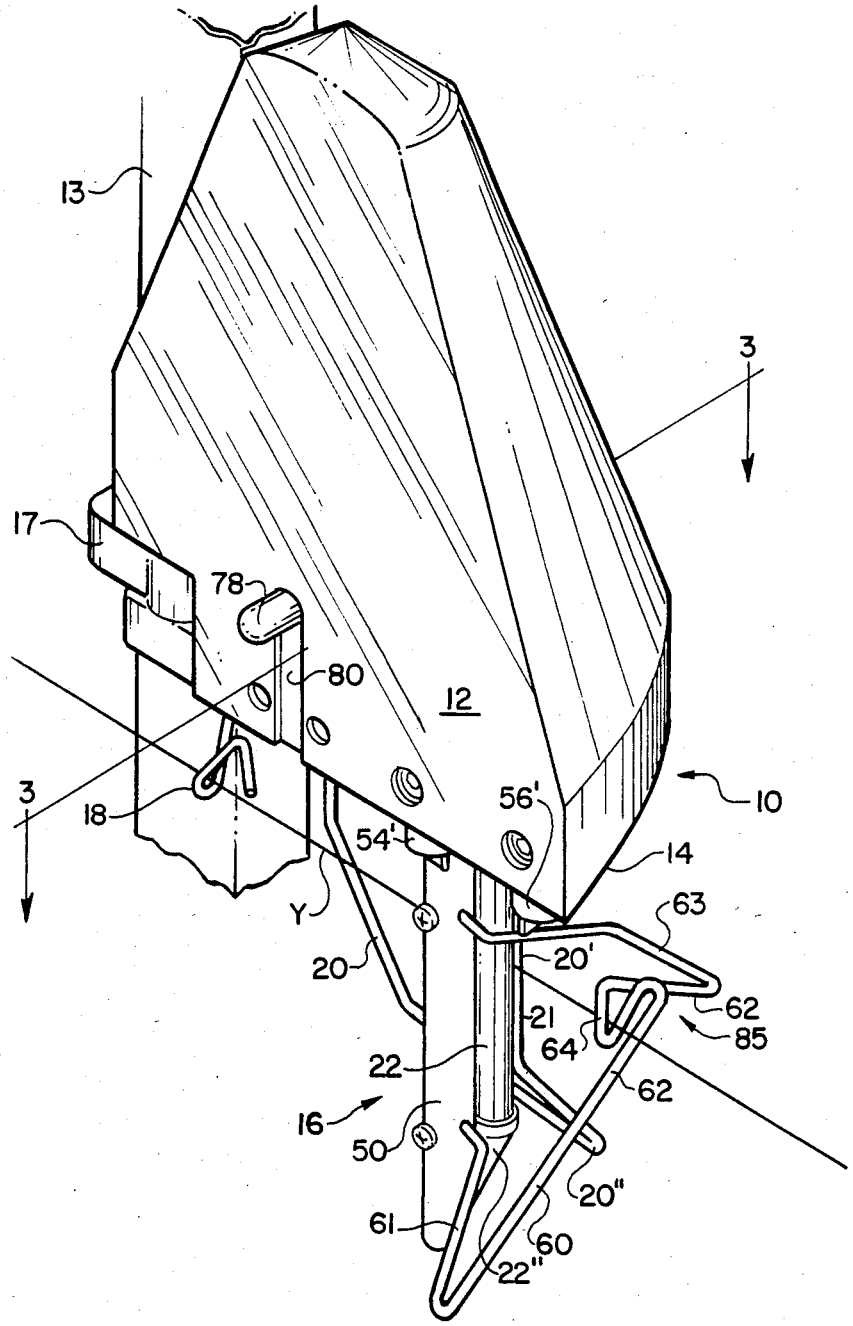
FIG. 1 is a perspective view of a strand tension controlling apparatus according to the preferred embodiment of the present invention.

Referring now to the accompanying drawings and initially to FIG. 1, a tension control device according to the preferred embodiment of the present invention is indicated generally at 10 in use for controlling the tension in a traveling textile yarn being fed from a yarn package, indicated representatively by P, to a textile machine, indicated representatively at T, which may be for instance a warper for preparing a beam of warp ends for a textile weaving operation. Basically, the device 10 includes a substantially hollow housing 12 the lowermost surface of which provides a base portion 14, a strand tensioning arrangement generally indicated at 16 movably mounted on the base portion 14 for variably engaging the traveling yarn Y to apply a variable frictional drag on the yarn Y, and a guide arrangement generally indicated at 18 for directing the yarn Y in a path of travel in tensioned engagement with the strand tensioning arrangement 16. The housing 12 is provided with a slotted portion 15 and a pivotable arm 17 for opening and closing the slotted area 15 to facilitate mounting of the device 10 on a supporting rail 13, such as typically provided on various textile machines and apparatus.

The strand tensioning arrangement 16 includes two yarn engaging members, a flutter member 20 and a post 22, mounted adjacent one another on the base portion 14. The flutter member 20 is formed of a wire rod or the like bent at an intermediate location to provide angularly-related legs 21, the flutter member 20 being pivotably mounted by one leg 21 in generally perpendicular relation to the base portion 14 by an integral pivot shaft 24 (FIGS. 2 and 3) extending perpendicularly through the base portion 14. Alternatively, the flutter member may be formed as a generally flat plate-like member, as desired. The post 22 is predominantly cylindrical in configuration and is also mounted perpendicularly to the base portion 14 by an integral eccentrically-positioned shaft 26 (FIG. 2) extending perpendicularly through the base for rotational movement of the post 22. Each shaft 24,26 extends through the hollow area within the housing 12 and is fitted rotatably in a mating bearing portion (not shown) formed interiorly within the housing 12 to support and stabilize the shafts 24,26 for pivotal and rotational movement of the respective flutter member 20 and post 22. Thus, each of the flutter member 20 and the post 22 is independently movable toward and away from one another with their respective mounting shafts 24,26 for movement into and out of surface contact between the cylindrical peripheral surface 22' of the post 22 and the adjacent facing surface 20' of the free leg 21 of the flutter member 20.

Figure 3:
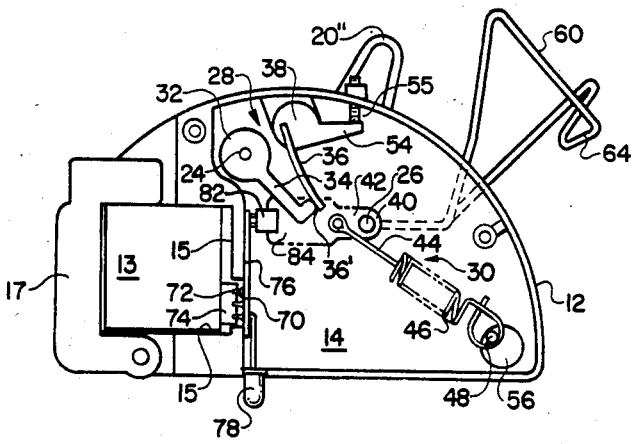
FIG. 3 is a horizontal cross sectional view thereof taken along line 3—3 of FIG. 1, also showing the elements of the strand tensioning arrangement in such resting disposition.

As best seen in FIG. 3, separate biasing spring arrangements indicated respectively at 28 and 30 are provided within the hollow area of the housing 12 for independently urging the shafts 24,26, respectively, into dispositions locating the yarn engaging surface portions 20',22' of the associated flutter member 20 and post 22 in surface contact with one another and for permitting independent movement of the post 22 and the flutter member 20 away from and toward one another. In this manner, the flutter member 20 and the post 22 are adapted for travel of the yarn Y between their engaging surfaces 20',22' for variably engaging the yarn Y therebetween to apply a variable frictional drag on the yarn Y.

The biasing arrangement 28 for the flutter member 20 includes a sleeve member 32 snugly fitted on the exposed length of the shaft 24 within the housing 12. A flat leaf spring 36 is affixed to a shaft 38 mounted on the interior surface of the base portion 14 and has an extending end 36' which bears against a projecting arm 34 on the sleeve member 32 to urge it and the shaft 24 rotatably in a clockwise direction as viewed in FIG. 3. Similarly, the biasing arrangement 30 includes a sleeve 40 fitted on the exposed length of the shaft 26 within the hollow housing 12 and having a projecting radial arm portion 42. One end of a plastic filament 44 is attached to the radial arm portion 42 eccentrically from the shaft 26 and the opposite end of the filament 44 is tied to one end of a coil spring 46, the opposite end of which is attached to a pin 48 also mounted on the interior surface of the base portion 14, thereby to urge the sleeve member 40 rotatably in a counterclockwise direction as viewed in FIG. 3.

Figure 2:
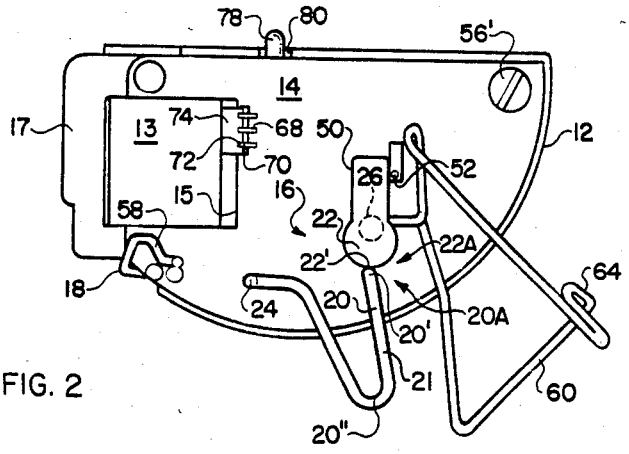
FIG. 2 is a bottom plan view thereof showing the elements of the strand tensioning arrangement in resting disposition.

As best seen in FIG. 2, the post 22 includes a leg portion 50 extending radially therefrom at the circumferential side thereof opposite the flutter member 20 and a protuberance 52 is formed on the exterior underside of the base portion 14 adjacent the leg 50 to abut therewith to act as a stop against rotational movement of the yarn engaging surface portion 22' of the post 22 toward the flutter member 20, i.e., clockwise as viewed in FIG. 2, under the urging force of its associated biasing arrangement 30. The resting position of the post 22 with the leg 50 in abutment with the protuberance 52 is indicated in FIG. 2 at 22A. As seen in FIG. 3, in such resting disposition, the radial arm 42 of the sleeve 40 projects angularly away from the pin 48, in which disposition, the filament extends between the radial arm 42 and the shaft 26 in alignment with the spring 46 and out of contact with the shaft 26. As will thus be understood, within an initial range of rotational movement of the post 22 from such resting disposition 22A, i.e., clockwise as viewed in FIG. 3, the filament 44 does not come in contact with the shaft 26. Within this initial range of movement, the radial arm 42 moves in an arcuate path the predominant component of movement of which is normal to the fixed end of the spring 46 at the pin 48 with only a minor component of the arcuate movement of the radial arm 42 effecting increased elongation of the coil spring 46. Accordingly, as the post 22 rotates away from its resting disposition 22A within such initial range of rotational movement, the biasing force exerted by the spring 46 against such movement increases at a decreasing rate of change. However, for the full range of further rotational movement of the post 22 beyond such initial range of movement, the filament 44 will be brought into surface contact with a portion of the periphery of the shaft 26. (See FIGS. 5 and 7). As will thus be understood, within this further range of rotational movement of the post 22, the increased elongation of the spring 46 beyond its most elongated disposition within the initial range of rotational movement of the post 22 will be substantially identical to the length of the filament 44 in surface contact with the shaft 26. In this manner, the peripheral surface of the shaft 26 acts as a cam to control the rate of change in the elongation of the spring 46 during rotational movement of the post 22 within this further range of movement. In the preferred embodiment of the present tension device 10, the shaft 26 has a cylindrical peripheral configuration so that a substantially constant rate of change in the biasing force exerted by the spring 46 on the post 22 is achieved within this further range of rotational movement of the post 22. However, those person skilled in the art will readily recognize that other peripheral configurations may be employed for the shaft 26 or, alternatively, a cam of a selected profile may be fitted on the shaft 26, to achieve any desired rate of change in the biasing force exerted by the spring 46.

Figure 7:
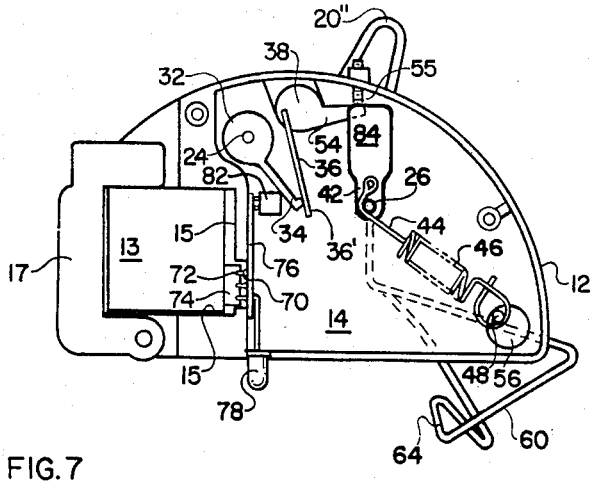
FIG. 7 is another horizontal cross-sectional view similar to FIGS. 3 and 5, also showing the elements of the strand tensioning arrangement in such extreme operating disposition.

As also seen in FIGS. 2 and 3, no separate stop arrangement is provided to limit the pivotal movement of the flutter member 20 toward the post 22. Instead, the sleeve member 32 and the leaf spring 36 of the biasing arrangement 28 are cooperatively arranged such that the biasing action of the leaf spring 36 on the radial arm 34 brings the flutter member 20 into an initial resting disposition, indicated at 20A in FIG. 2, biased into surface contact against the post 22, which thereby acts as a stop to the flutter member 20. Preferably, leaf spring 36 is thusly arranged to be deflected in such initial disposition 20A only a small degree out of its relaxed straightened condition, as seen in FIG. 3, to provide only a predetermined small degree of biasing force against the radial arm 34 in such initial disposition 20A tending to urge the flutter member 20 further toward the post 22 to cause the flutter member 20 to pivot under the urging force of the spring 36 only a small further distance toward the post 22 in following relation to the post 22 as it rotates through an initial range of movement away from the flutter member 20 (ordinarily a greater range of initial post rotation than the post rotation between its resting position and its position whereat the filament 44 contacts the shaft 26, as described above), i.e., until the deflection in the spring 36 is fully released to relax the spring 36, as shown in FIG. 7.

Each of the shaft 38 and the pin 48 employed in the biasing arrangements 28,30 to provide the fixed mounting location for the respective springs 36,46, is mounted on the interior surface of the base portion 14 for selective movement within at least a limited range to permit fine adjustment of the spring biasing characteristics of the biasing arrangements 28,30. For this purpose, the shaft 38 is rotatably mounted within the base portion 14 and has an extending arm 54 which engages a screw 55 threadedly supported in the adjacent side wall of the housing 12 to act as a stop against counterclockwise rotation of the shaft 38, as viewed in FIG. 3. Threaded withdrawal of the screw 55 outwardly of the housing 12 permits the leaf spring 36 to relieve biasing tensioned deflection thereof by effecting counterclockwise rotation of the shaft 38, as viewed in FIG. 3. Conversely, threaded movement of the screw 55 further into the housing 12 produces greater deflection and greater biasing tension in the spring 36 by causing clockwise rotation of the shaft 38, as viewed in FIG. 3. Thus, the biasing force exerted by the spring 36 to urge the flutter member 20 against the post 22 when in surface contact therewith in the initial resting position 20A of the flutter member 20 may be selectively varied as desired. The pin 48, on the other hand, is formed eccentrically on a shaft 56 rotatably mounted within the base portion 14, whereby the location of the pin 48 may be selectively adjusted within a range of circular movement. Thus, as desired, the pin 48 may be selectively positioned more closely to or farther away from the radial arm 42 to cause the spring 46 to exert a greater or lesser biasing force in the resting disposition of the the post 22 in surface contact with the flutter member 20. Additionally, the location of pin 48 may be selectively adjusted between opposte circumferential locations generally normal to the position of the radial arm 42. to produce fine modifications in the degree of rotational movement of the post 22 within its aforedescribed initial and further ranges of rotational movement before and after the filament 44 contacts the shaft 26. For convenience, the shaft 56 extends outwardly through the base portion 14 and has an exposed knob portion 56', at the exterior underside of the base portion 14 to facilitate easy manual adjustment of the location of the pin 48 in the aforedescribed manner.

The guide arrangement 18 includes a self-threading type pigtail yarn guide eyelet 58 affixed to the base portion 14 at one end thereof directly adjacent the location of surface contact between the flutter member 20 and the post 22 to receive the yarn Y fed from a supply such as the yarn package P and to direct the yarn between the flutter member 20 and the post 22. The eyelet 58 is provided with an elliptical shape elongated in the vertical direction in order to allow some degree of vertical yarn movement during operation of the device to prevent undue localized wearing of the yarn engaging surfaces 20',22' of the flutter member 20 and the post 22.

The strand tensioning arrangement 16 further includes a yarn monitoring arm 60 affixed integrally to the leg 50 of the post 22 and extending outwardly therefrom away from the guide eyelet 58 for engagement with the yarn Y at a downline spacing from the post 22 and the flutter member 20. The yarn monitoring arm 60 has two V-shaped portions 61,63, respectively affixed at the top and bottom areas of the leg 50. The V-shaped portions have respective converging legs 62 which overlap and are configured to form another yarn guide eyelet 64 at the projecting free end of the yarn monitoring arm 60. The traveling yarn Y is also trained through this yarn guide eyelet 64 to pass therethrough after traveling between the post 22 and the flutter member 20. As more fully explained hereinafter, the tension conditions prevailing in the yarn Y act on the yarn monitoring arm 60 to cause it and the post 22 to rotate back and forth in response to tension fluctuations in the yarn Y to thereby regulate the amount of frictional drag imposed on the yarn Y at the flutter member 20 and the post 22 in compensation for such fluctuations.

Figure 4:
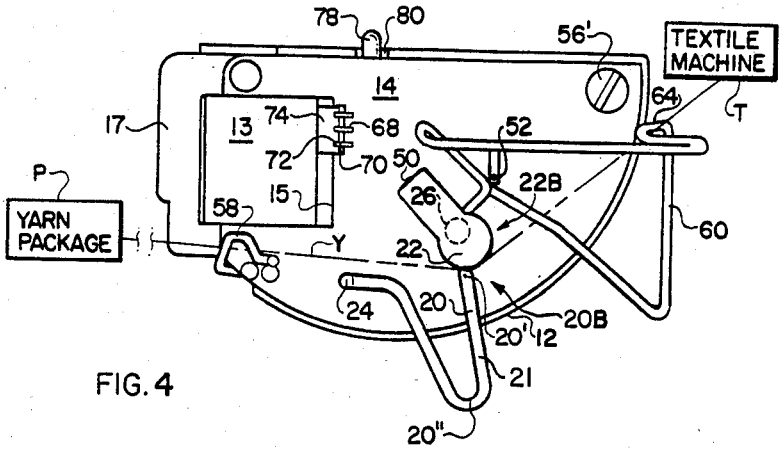
FIG. 4 is another bottom plan view similar to FIG. 2, showing the elements of the strand tensioning arrangement in a normal operating disposition.
Figure 5:
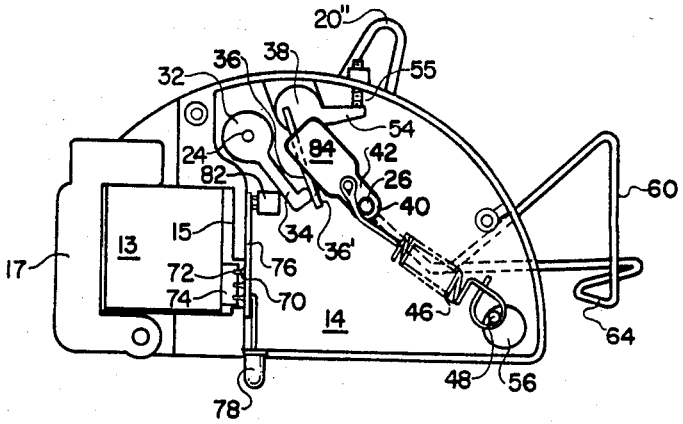
FIG. 5 is another horizontal cross-sectional view similar to FIG. 3, also showing the elements of the strand tensioning arrangement in such normal operating disposition.
Figure 6:
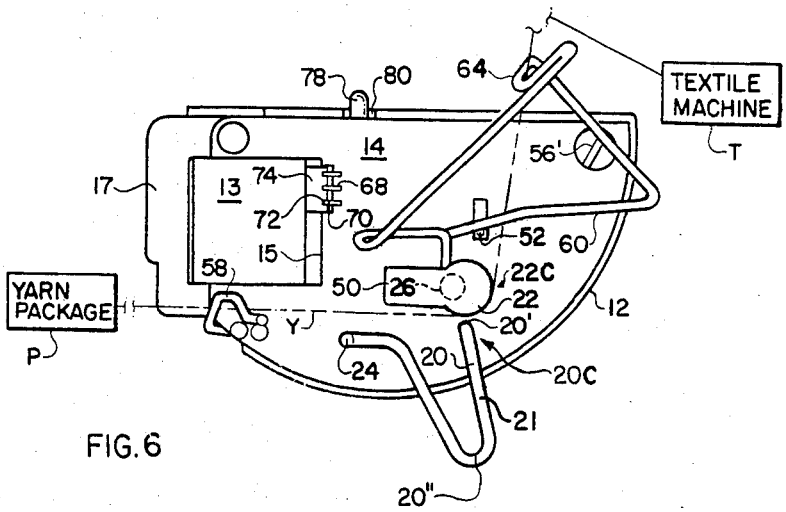
FIG. 6 is another bottom plan view similar to FIGS. 2 and 4, showing the elements of the strand tensioning arrangement in an extreme operating disposition under the effects of excessive yarn tension.

The operation of the present yarn tension control device 10 will thus be understood with references to FIGS. 2–7 wherein the elements of the strand tensioning arrangement are shown in resting disposition in FIGS. 2 and 3, in normal operating disposition in FIGS. 4 and 5, and in extreme operating disposition in FIGS. 6 and 7, as fully explained hereinafter. In setting up the device 10 for use, yarn Y is initially drawn from the package P and threaded through the entrance eyelet 58, between the flutter member 20 and the post 22, and through the eyelet 64 at the free end of the yarn monitoring arm 60. The yarn Y is directed next to its point of use, e.g., the textile machine T or to the succeeding location in the yarn handling system, for which purpose, one or more conventional additional yarn guide eyelets (not shown), or other conventional yarn transporting arrangement, will typically be provided. According to the present invention, the device 10 is oriented with respect to the location of the textile machine T or the next yarn engaging member succeeding the device 10, so that the linear path of travel of the yarn Y from the entrance eyelet 58 to the location of frictional contact of the yarn between the flutter member 20 and the post 22 is sufficiently horizontally out of alignment with the textile machine T to cause the yarn Y to travel from the contact location between the flutter member 20 and the post 22 about the yarn monitoring arm 60 at an acute angle toward the textile machine T. As will be understood, traveling movement of the yarn Y will be initiated by, and in relation to, the taking-up of the yarn at its ultimate down line point of use. During the course of such yarn travel, a number of factors can affect the amount of tension prevailing in the yarn Y, e.g., the natural tension imposed on the yarn Y in the formation of the yarn package P, the rate of use of the yarn Y at its downline point of use, and various frictional and other forces acting upon the yarn Y intermediate the package P and point of use, including frictional drag imposed on the yarn Y by the yarn engaging surfaces 20',22' of the flutter member 20 and the post 22. Accordingly, the prevailing tension in the yarn Y downline from the flutter member 20 and the post 22 creates a tendency in the yarn Y to assume a linear path of travel therebetween whereby the tension in the yarn acts upon the yarn monitoring arm 60 to rotate it and the post 22 against the biasing force of the biasing arrangement 30. The biasing force of the spring 46 is selected to be sufficiently weak to ordinarily be overcome by tension levels in the yarn Y predetermined to be above a desirable minimum tension amount so that the yarn monitoring arm 60 and the post 22 normally assume a rotated disposition, such as that shown at 22B in FIG. 4, during ordinary operation of the device 10.

As will be understood, each of the factors in the yarn handling system affecting the imposition of tension on the yarn Y will vary to at least some extent during the course of operation of the yarn handling system and will produce fluctuations in the amounts of tension in the yarn Y. Since the biasing arrangements 28,30 urge the flutter member 20 and the post 22 into surface contact with one another, it will be understood that essentially the maximum amount of frictional drag which the flutter member 20 and the post 22 are capable of imposing on the yarn Y is exerted when the post 22 is in its resting position 22A and the flutter member 20 is in surface contact therewith in its resting disposition 20A. (FIG. 2). Since the effects of prevailing normal tension in the yarn Y will maintain the yarn monitoring arm 60 and the post 22 in the operating disposition 22B rotated from the resting disposition under ordinary circumstances, as described above, the flutter member 20 and the post 22 will normally place a somewhat lesser frictional drag on the yarn Y under such normal operating conditions of the device 10. As previously indicated, the shaft 38 can be adjusted, as desired, so that the biasing arrangement 28 for the flutter member 20 exerts sufficient biasing force on the flutter member 20 to maintain the flutter member 20 in surface contact with the post 22 such as at 20B in FIG. 4 throughout some range of normal operating rotational movement of the post 22 from its resting disposition 22A. According to the present invention, the springs 36,46 of the biasing arrangements 28,30 are of selected strengths and are adjusted by the shafts 38,56 so that when the flutter member 20 and the post 22 are in their described normal operating positions shown at 20B,22B in FIG. 4, a predetermined amount of frictional drag is exerted on the yarn Y between the flutter member 20 and the post 22 to produce a corresponding amount of tension in the yarn Y which is desirable to be maintained substantially constant.

As tension fluctuations in the yarn Y occur during the course of operation of the device 10, the yarn monitoring arm 60 and the post 22 rotate as a unit in response and relation thereto. More particularly, when the prevailing tension in the yarn Y increases, the resultingly greater tautness in the yarn Y will act on the yarn monitoring arm 60 to cause it and the post 22 to rotate unitarily beyond their operating disposition 22B an increased distance in the rotational direction away from their resting disposition 22A in direct relation to the amount of the yarn tension increase. As a result, the flutter member 20 will follow the rotation of the post 22 relieving a corresponding amount of the biasing tension exerted on the flutter member 20 by its biasing arrangement 28 to decrease the amount of the frictional drag imposed on the yarn Y between the flutter member 20 and the post 22 to compensate for and offset the yarn tension increase. As will be understood, in cases of extreme tension increases in the yarn Y, the yarn monitoring arm 60 and the post 22 will move to a sufficient extent, such as at 22C in FIG. 6, to cause the post 22 to rotate beyond the point at which the biasing tension in the spring 36 of the biasing arrangement 28 for the flutter member 20 is fully relieved, i.e., disposition 20C in FIG. 6, so that the post 22 separates from the flutter member 20 to fully relieve the frictional drag on the yarn Y. Conversely, when a decrease in the tension in the yarn Y occurs, the resultingly decreased tautness in the yarn Y will enable the biasing arrangement 30 for the post 22 to rotatably return the yarn monitoring arm 60 and the post 22 a corresponding distance toward their resting disposition 22A in direct relation to the amount of the tension decrease. As a result, the flutter member 20 is moved in following relation to the post 22 a corresponding distance against the force of the biasing arrangement 28 to increase the biasing force exerted thereby on the flutter member 20 and, in turn, producing a corresponding increase in the amount of frictional drag imposed on the yarn Y between the flutter member 20 and the post 22, compensating for and offsetting the yarn tension decrease. In this manner, the yarn monitoring arm 60 serves to follow and mechanically sense tension fluctuations in the yarn Y and to produce compensating movement of the post 22 to cause the following flutter member 20 to exert appropriately decreased or increased frictional drag on the yarn Y to maintain the prevailing tension in the yarn Y within a relatively small range about a desired constant value of yarn tension.

It will be understood that textile yarn naturally tends to ballon during longitudinal travel at any significant speed, and this yarn action may cause untwisting of the yarn which can deleteriously affect the yarn quality and the quality of textile products formed therewith. The flutter member 20 and the biasing arrangement 28 for the flutter member 20 are cooperatively adapted to yield to permit the flutter member 20 to move away from and toward the post 22 in a rapid flutter-like fashion, such as between positions 20A and 20B during ordinary operation, in response to yarn ballooning to act to continuously impose and relieve in quick repitition the aforesaid frictional drag on the yarn Y. The absence of any physical attachment or connection between the leaf spring 36 and the radial arm 34 of the biasing arrangement 28 aids in permitting this flutter-like action of the flutter member 20. This flutter-like action of the flutter member 20 serves to dampen the ballooning action of the yarn Y to retard or prevent yarn untwisting and also enables the device 10 to maintain the desired frictional drag on the yarn Y during such ballooning action of the yarn Y, thereby preventing the ballooning action from creating an undesired further impediment to the traveling movement of the yarn Y which would increase the overall amount of tension in the yarn Y. As a result, the present device 10 is capable of effective operation to maintain yarn tension at unconventionally low levels. Textile yarn is also subject to variations in thickness along the yarn length, such as caused by slubs in the yarn or simply by variations in yarn count. The biasing arrangement 28 for the flutter member 20 is also adapted to yield to permit it to pivot sufficiently away from the post 22 in response to such yarn thickness variation to permit the thicker yarn portions to pass between the post 22 and the flutter member 20 without producing an undesired increase in yarn tension.

One important advantage provided by the present tension controlling device 10 is its aforementioned capability for maintaining a very low tension level in the traveling yarn Y. The present device 10 is significantly distinguished over conventional yarn tensioning devices in that the essential operation and effect of the present device 10 is to control yarn tension rather than to impose yarn tension. As fully described above, the rotational movement of the post 22 and the yarn monitoring arm 60 in relation to increases and decreases in the prevailing tension conditions in the traveling yarn Y serve to maintain a generally constant tension level in the yarn Y be relieving frictional drag on the yarn Y between the flutter member 20 and the post 22 in response to yarn tension increases. As also abovedescribed, the flutter-like operation of the flutter member 20 toward and away from the post 22 repetitively imposes and relieves frictional drag on the yarn Y between the flutter member 20 and the post 22, even under conditions of a consant tension value in the yarn Y. In this manner, the flutter member 20 prevents the imposition of a continuous frictional drag on the yarn Y, as is typical of most conventional yarn tension control devices, and accordingly, the flutter member 20 itself serves in part to relieve tension increases in the yarn Y further enabling the device 10 to maintain the tension in the yarn Y at a minimum. Thus, the device 10 imposes only a minimum amount of additional tension in the yarn Y over the tension naturally prevailing therein as a result of the remainder of the yarn handling system, in order to regulate the tension at a desired constant level. The aforedescribed effect of the biasing arrangement 30 for the post 22 in modifying the rate of change in the biasing force applied to the post 30 over the range of movement of the post 22 and the yarn monitoring arm 60, contributes to the capability of the device 10 for operating at very low yarn tension values. The decreasing rate of increase in the biasing force of the biasing arrangement 30 within the initial range of movement of the post 22 and the yarn monitoring arm 60 from their resting disposition 22A insures that the spring 46 exerts only a minimally greater biasing force on the post 22 and the yarn monitoring arm 60 when they are moved therefrom to a normal operating disposition such as indicated at 22B. As also described above, any further movement of the yarn monitoring arm 60 and the post 22 from the normal operating disposition 22B is accompanied by a constant level rate of change in the biasing force of the spring 46 in direct proportion to the degree of rotational movement of the post 22 and the yarn monitoring arm 60. In this manner, the biasing arrangement 30 insures that the biasing action of the spring 46 on the post 22 and the yarn monitoring arm 60 increases and decreases over the full range of movement of the post 22 and the yarn monitoring arm 60 away from and toward their resting disposition 22A, which insures proper operating response of the post 22 and the yarn monitoring arm 60 to tension fluctuations in the yarn Y, while also maintaining the gross amount of additional tension which the post 22 and the yarn monitoring arm 70 are capable of imposing on the yarn Y to a minimum.

According to a further feature of the present tension controlling device 10, an electrically-operated stop motion is provided to alert operating personnel in the event of a breakage or other substantially total loss of tension in the yarn Y during operation of the device 10. For this purpose, the recess 15 in the housing 12 is provided with several vertically-formed slots 68 which are fitted with electrical contact elements 70 having projecting contact pins 72. The support rail 13 is preferably provided on the side thereof facing the slots 68 with a conventional electrical supply system, indicated representatively at 74, for contact with the pins 72 when the device 10 is mounted on the rail 13 to supply electrical current to the contact elements 70. An integrated electrical circuit board 76 is mounted within the hollow area of the housing 12 in electrical contact with the contact element 70 and includes a signal lamp 78 which projects outwardly through a slot 80 in the housing 12. The circuit board 76 also includes a pair of electric eyes 82 and is adapted to prevent flow of electrical operating current through the lamp 78 so long as the area between the electric eyes 82 is unobstructed. The radial arm 42 of the biasing arrangement 30 for the post 22 includes a projecting portion 84 which is adapted to be positioned between the electric eyes 82 when the post 22 is in its resting disposition 22A. Accordingly, during ordinary operation of the device 10, the projecting portion 84 is maintained out of position between the electric eyes 82 since the post 22 is in a moved disposition such as at 22B, whereby no electrical current is supplied to the lamp 78. However, upon any breakage of the yarn Y or any other substantial loss in the tension thereof, the post 22 will return substantially to its resting disposition 22A wherein the projecting portion 84 will be disposed between the electric eyes 82, thereby effecting completion of an electrical circuit through the lamp 78 to indicate the yarn breakage.

The entrance guide eyelet 58, the flutter member 20, the post 22, and the yarn monitoring arm 60 are each cooperatively configured to provide substantial ease in the thread-up of the device 10. For this purpose, the flutter member 20 and the post 22 are formed with respective yarn guiding surface portions 20″,22″ diverging outwardly from one another at the lowermost free ends of the flutter member 20 and the post 22, thus cooperatively providing a V-shaped channel indicated at 85 in FIG. 1 for directing yarn engaging the surface portions 20″,22″ to be directed between the flutter member 20 and the post 22. Similarly, the double V-shaped configuration of the yarn monitoring arm 60 is effective to provide a like V-shaped channel to direct yarn into the guide eyelet 64 at the projecting end of the yarn monitoring arm 60. The yarn Y can thus be conveniently and easily threaded through the device 10 by drawing the yarn upwardly over the yarn monitoring arm 60 and through the V-shaped channel formed by the surface portions 20″,22″ of the flutter member 20 and the post 22 and then, in conventional manner, turning the yarn counter to the twist direction of the pigtail eyelet 58 to thread the yarn therethrough.

The illustrated and described disposition of the device 10 with the housing 12 facing upwardly and the strand tensioning arrangement extending downwardly therefrom provides the advantage of shielding the various yarn engaging components from the settling of airborne fibrous lint and debris to aid in preventing the collection of lint and other debris on these components and possibly being picked up by the traveling yarn. The shape of the housing 12 aids in deflecting falling lint away from the yarn engaging components of the device. Of course, as will be understood, the device may be equally well employed in the opposite disposition with the housing 12 facing downwardly and the strand tensioning arrangement extending upwardly, particularly where compressed air or other lint removal systems are employed to blow accumulated lint off and away from the device.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. Apparatus for controlling the tension in advancing strand material comprising:

a base;

strand tensioning means movably mounted on said base for variable engagement with said advancing strand for applying a variable frictional drag on said strand, said tensioning means including movable control means arranged for engagement with said strand for movement in response to tension fluctuations in said strand for decreasing and increasing the frictional drag applied thereto in relation to increases and decreases in the amount of tension in said strand to compensate for and offset tension fluctuations from a desired constant tension value, said strand tensioning means including two adjacent strand engaging surfaces aranged for strand travel therebetween, said surfaces being independently movable toward and away from surface engagement with one another for engaging said traveling strand therebetween to apply said frictional drag thereto;

means for independently biasing each said surface toward surface engagement with one another, said biasing means including means for urging one said surface into following relation with the other said surface for exerting a decreasing biasing force during movement of said other surface in the direction away from said one surface, for increasing and decreasing the frictional drag on said strand in direct relation to the movement of said other surface in the directions toward and away from said one surface, and said biasing means including means for applying a biasing force to said other surface at a predetermined varying rate of change in direct relation to the degree of movement of said other surface toward and away from said one surface; and guide means for directing said advancing strand in a path of travel in engagement with said strand tensioning means and in tensioned engagement with said control means;

whereby fluctuations in the tension in said strand are controlled and the strand tension is maintained within a substantially uniform range.

2. Apparatus for controlling the tension in advancing strand material according to claim 1 and characterized further in that said control means is rigidly fixed with one said surface for unitary movement therewith for controlling movement thereof in the directions toward and away from the other said surface, said control means extending outwardly from said one surface for engagement with said strand.

3. Apparatus for controlling the tension in advancing strand material according to claim 2 and characterized further in that said control means is arranged to engage said strand at a downline spacing from said strand engaging surfaces.

4. Apparatus for controlling the tension in advancing strand material according to claim 2 and characterized further in that said urging means is arranged to yield to variations in strand thickness and to ballooning and untwisting actions of said strand for dampening said actions.

5. Apparatus for controlling the tension in advancing strand material according to claim 1 and characterized further in that said biasing means includes means for selectively fine adjusting the biasing force and disposition thereof.

6. Apparatus for controlling the tension in advancing strand material according to claim 1 and characterized further in that said biasing means includes cam means for causing said biasing means to apply said biasing force to said other surface at a decreasing rate of change during movement of said other surface in an initial range of movement thereof away from said one surface and at least at a generally constant rate of change during movement of said other surface in a further range of movement thereof.

7. Apparatus for controlling the tension in advancing strand material according to claim 1 and characterized further in that said strand tensioning means is cooperatively configured to direct said strand into proper advancing position between said strand engaging surfaces upon manual drawing of said strand between said strand engaging surfaces for easy threading-up of said strand.

8. Apparatus for controlling the tension in advancing strand material according to claim 1 and characterized further by a housing arranged in overlying covering relation to said strand tensioning means, said biasing means and said guide means and configured to deflect airborne debris outwardly away therefrom to prevent debris accumulation thereon.

9. Apparatus for controlling the tension in a traveling yarn or like strand material, comprising:

a base;

two yarn engaging members adjacently mounted on said base for independent movement toward and away from one another, one said yarn engaging member being pivotably mounted on said base and the other said yarn engaging member being rotatably mounted on said base eccentrically about an axis generally parallel to said one yarn engaging member for rotational movement toward and away from said one yarn engaging member;

means for independently biasing said yarn engaging members toward surface contact with one another and for yieldably permitting independent movement of said yarn engaging members away from and toward one another for variably engaging said traveling yarn between said yarn engaging members for applying a variable frictional drag on said yarn;

said biasing means including means for urging said one yarn engaging member into following relation with the other said yarn engaging member with a decreasing biasing force during an initial range of movement of said other yarn engaging member in the direction away from said one yarn engaging member and thereafter to be out of contact with said other yarn engaging member, for increasing and decreasing the frictional drag on said yarn in direct relation to movement of said other yarn engaging member in the directions toward and away from said one yarn engaging member, and for yielding to variations in yarn thickness and to ballooning and untwisting actions of said yarn for dampening said actions while maintaining said frictional drag on said yarn;

said biasing means further including means for applying a biasing force to said other yarn engaging member at a predetermined varying rate of change in direct relation to the degree of movement thereof toward and away from said one yarn engaging member;

a yarn monitoring member affixed integrally with said other yarn engaging member for unitary movement therewith and arranged for engagement with said yarn for movement in response to tension fluctuations therein for controlling movement of said other yarn engaging member in the directions toward and away from said one yarn engaging member in direct relation to decreases and increases in the amount of tension in said yarn for correspondingly increasing and decreasing said frictional drag applied to said yarn to compensate for and offset variations in yarn tension from a desired constant tension value; and yarn guide means for directing said yarn to travel between said yarn engaging members and in tensioned engagement with said yarn monitoring member;

whereby fluctuations in the tension in said yarn are controlled and the strand tension is maintained within a substantially uniform range.

10. Apparatus for controlling the tension in a traveling yarn or like strand material according to claim 9 and characterized further in that said yarn monitoring member is arranged to engage said strand at a downline spacing from said engaging members.

11. Apparatus for controlling the tension in a traveling yarn or like strand material according to claim 9 characterized further in that said biasing means includes means for selectively fine adjusting the biasing force and disposition of said biasing means.

12. Apparatus for controlling the tension in a traveling yarn or like strand material according to claim 9 and characterized further in that said biasing means includes cam means for causing said biasing means to apply said biasing force at a decreasing rate of change during movement of said other yarn engaging member in another initial range of movement thereof in the direction away from said one yarn engaging member and at least at a generally constant rate of change during movement of said other yarn engaging member in a further range of movement thereof beyond said another range of movement.

13. Apparatus for controlling the tension in a traveling yarn or like strand material according to claim 12 and characterized further in that said cam means of said biasing means is affixed to said other yarn engaging member for integral movement therewith about said axis, said biasing means further including a biasing element affixed to said other yarn engaging member eccentrically from said axis for biasing movement upon movement of said other yarn engaging member, said biasing element being arranged for biasing movement out of engagement with said cam means during movement of said other yarn engaging member in its said another initial range of movement and for biasing movement in engagement with said cam means during movement of said other yarn engaging member in its said further range of movement.

14. Apparatus for controlling the tension in a traveling yarn or like strand material according to claim 10 and characterized further in that said yarn engaging members are cooperatively configured to direct said yarn into proper traveling position between said yarn engaging members upon manual drawing of said yarn between said yard engaging members for easy threading-up of said yarn.

15. Apparatus for controlling the tension in a traveling yarn or like strand material according to claim 10 and characterized further by a housing arranged in overlying relation to said yarn engaging members, said biasing means, said yarn monitoring member and said guide means and configured to deflect airborne debris outwardly away therefrom to prevent debris accumulation thereon.

16. Apparatus for controlling the tension in a traveling yarn or like strand material comprising:

a base;

a flutter member pivotably mounted on said base;

a post rotatably mounted on said base adjacent and parallel to said flutter member and eccentrically about an axis substantially parallel to the pivot axis of said flutter member;

means for independently biasing said flutter member and said post toward surface contact with one another and for yieldably permitting independent pivotal movement of said flutter member and rotational movement of said post away from and toward one another for variably engaging said traveling yarn between said flutter member and said post for applying a variable frictional drag on said yarn;

said biasing means including means for urging said flutter member into following relation with said post with a decreasing biasing force during an initial range of rotational movement of said post in the direction away from said flutter member, for increasing and decreasing the frictional drag on said yarn in direct relation to rotational movement of said post in the directions toward and away from said flutter member, and for permitting said flutter member to yield to variations in yarn thickness and for flutter-like pivotal movement toward and away from said post in response to ballooning and untwisting actions of said yarn for dampening said yarn actions while maintaining said frictional drag on said yarn;

said biasing means including cam means for causing said biasing means to apply a biasing force to said post at a decreasing rate of change during movement of said post in another initial range of rotational movement thereof in its rotational direction away from said flutter member and at least at a generally constant rate of change during movement of said post in a further range of rotational movement thereof beyond said another initial range of movement;

a yarn monitoring arm arranged for engagement with said yarn for movement in response to tension fluctuations in said yarn, said yarn monitoring arm being affixed integrally with said post for unitary movement therewith and extending outwardly therefrom for engagement with said yarn for movement in response to tension fluctuations therein for controlling rotational movement of said post in the directions toward and away from said flutter member in direct relation to decreases and increases in the amount of tension in said yarn for correspondingly increasing and decreasing said frictional drag applied to said yarn to compensate for and offset variations in yarn tension from a desired constant tension value; and yarn guide means for directing said yarn to travel between said flutter member and said post and in tensioned engagement with said arm;

whereby fluctuations in the tension in said yarn are controlled and the yarn tension is maintained within a substantially uniform range.

17. Apparatus for controlling the tension in a traveling yarn or like strand material according to claim 16 and characterized further in that said yarn monitoring arm is arranged to engage said yarn at a downline spacing from said post and said flutter member.

18. Apparatus for controlling the tension in a traveling yarn or like strand material according to claim 16 and characterized further in that said biasing means includes means for selectively fine adjusting the biasing force and disposition of said biasing means.

19. Apparatus for controlling the tension in a traveling yarn or like strand material according to claim 16 and characterized further in that said cam means is affixed to said post for integral movement therewith about its said rotational axis, said biasing means further including a biasing member affixed to said post eccentrically from said axis for biasing movement upon rotation of said post, said biasing element being arranged for biasing movement out of engagement with said cam means during movement of said post in its said another initial range of movement and for biasing movement in engagement with said cam means during movement of said post in its said further range of movement.

20. Apparatus for controlling the tension in a traveling yarn or like strand material according to claim 16 and characterized further in that said flutter member and said post are cooperatively configured to direct said yarn into proper traveling position therebetween upon manual drawing of said yarn between said flutter member and said post for easy threading-up of said yarn.

21. Apparatus for controlling the tension in a traveling yarn or like strand material according to claim 16 and characterized further by a housing arranged in overlying relation to said flutter member, said post, said biasing means, said yarn monitoring member and said guide means and configured to deflect airborne debris outwardly away therefrom to prevent debris accumulation thereon.

* * * * *